United States Patent [19]

King

[11] 4,156,748

[45] May 29, 1979

[54] METHOD OF PROCESSING A COATED STRAND

[75] Inventor: Gregory C. King, Columbus, Ohio

[73] Assignee: Owens-Corning Fiberglas Corporation, Toledo, Ohio

[21] Appl. No.: 819,202

[22] Filed: Jul. 26, 1977

[51] Int. Cl.[2] ..... B05D 3/02

[52] U.S. Cl. ..... 427/373; 427/178; 427/374 R; 427/398 B; 427/398 C; 427/444

[58] Field of Search ..... 427/444, 398 B, 398 C, 427/398 D, 374 R, 373, 178

[56] References Cited

U.S. PATENT DOCUMENTS

| | | | |
|---|---|---|---|
| Re. 19,758 | 11/1935 | Underwood | 427/398 B |
| 1,670,262 | 5/1928 | Kershaw | 427/398 B |
| 2,070,554 | 2/1937 | Schueler et al. | 427/398 B |
| 2,094,583 | 10/1937 | Cook et al. | 427/398 B |
| 3,754,957 | 8/1973 | Druin et al. | 427/444 |
| 3,761,346 | 9/1973 | Caroselli et al. | 428/152 |
| 3,850,671 | 11/1974 | Petty et al. | 427/444 |
| 3,895,126 | 7/1975 | Strauss et al. | 427/398 B |

*Primary Examiner*—Ronald H. Smith
*Assistant Examiner*—Sadie L. Childs
*Attorney, Agent, or Firm*—Ronald C. Hudgens; Philip R. Cloutier; Greg Dziegielewski

[57] ABSTRACT

A method of processing a coated strand comprises heating the strand; directing a gas at the strand to cool and support the strand; and moving the strand through a zone having an atomized mist of liquid therein to cool the strand.

14 Claims, 4 Drawing Figures

METHOD OF PROCESSING A COATED STRAND

BACKGROUND OF THE INVENTION

Flexible materials of a plastic composition, particularly when foamed, have found use in the field of textiles on the decorative side of fabrics and as coatings on individual textile units such as yarns, strands, and threads. Some materials can be processed as a coating on a strand to produce a coated strand having unique characteristics depending upon the method employed in processing the strand.

For example, U.S. Pat. No. 3,761,346, issued Sept. 25, 1973 to Caroselli et al. discloses a system wherein a plastisol is applied to a linear textile material such as a strand of glass filaments by passing the textile material through an excess of plastisol via two coating/wiping dyes and then advancing the coated textile material into an oven for partial fusion. Subsequently, a second plastisol is applied via a second set of two coating/wiping dyes, followed by a second thermal treatment sufficient to first fuse the coatings and then to activate the blowing agent therein to create a foam-like structure. The second plastisol may or may not contain a blowing agent. Without the blowing agent in the second coating the outer surface of the strand will not have the pits or voids therein which would have been formed if a blowing agent were present.

However, in either instance a nozzle sprays water onto the strand as it leaves the second oven to cool the strand. It has been found that by directing a stream of water against the surface of such a strand while the coating is still in a deformable or tacky state the resulting coated strand will have a wrinkled and dented outer surface even when the second coating does not contain a blowing agent. It is believed that the immediate rapid cooling of the strand by the spray of water contacting the coated strand immediately after leaving the oven causes the coating material to shrink forming the wrinkled outer surface. Since the coating material is still in a delicate tacky or deformable state, the impact of large drops of water upon the strand tends to form indentations therein.

Therefore, it is believed that cooling the coating of the strand according to the principles of this invention permits the coating to expand to and remain at substantially the maximum extent thereof.

SUMMARY OF THE INVENTION

This invention pertains to a method of processing a coated strand by heating the strand, then directing a gas at the strand to cool the strand, and then moving the strand through a zone having an atomized mist of liquid therein to further cool the strand.

It is an object of this invention to provide a method and apparatus for cooling a linear material having a coating thereon in the absence of an undue amount of surface deformation occurring in the coating.

It is another object of this invention to provide a method for producing a composite strand having a smooth, non-lustrous, unwrinkled outer surface over a foam core.

DESCRIPTION OF THE PREFERRED EMBODIMENTS

Figure 1:
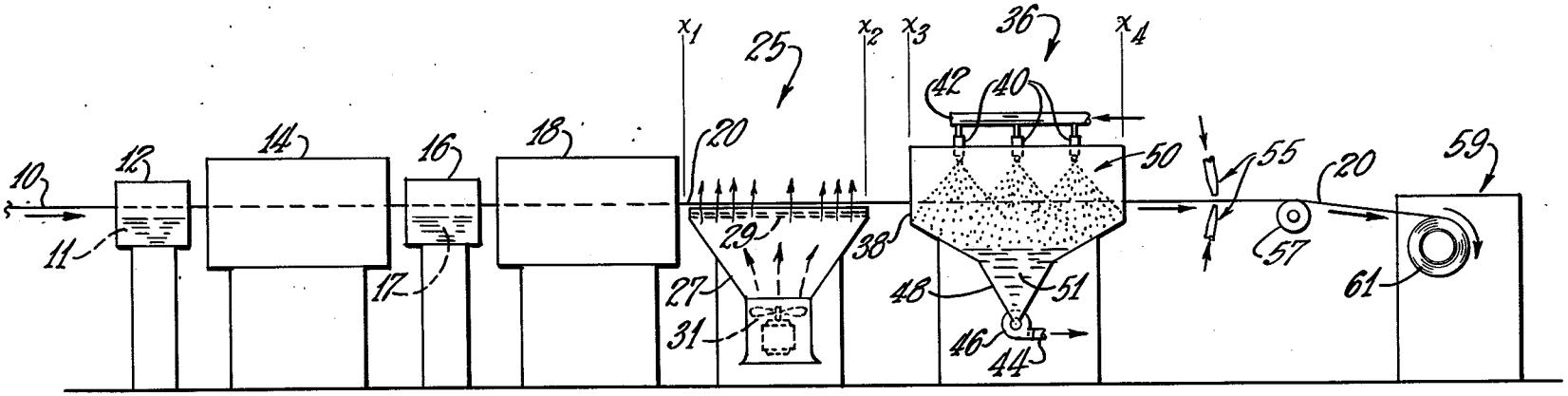
FIG. 1 is a schematic representation of the system employed in producing the composite strand according to the principles of this invention.

As shown in FIG. 1, a first coating material 11, which can be a plastisol, is applied to a bundle of filaments advancing through a first coating station 12. The bundle of filaments, or strand 10, can be a group of glass filaments having a suitable sizing material thereon. The first coating material 11 can contain a blowing agent. The strand 10 then passes through oven 14 which can be a conventional thermal oven. In practice, the strand with the coating thereon is heated to partially fuse the first coating material in the absence of activating the blowing agent contained therein.

Then the strand 10 passes through a second coating station 16 to receive a layer of a second coating material 17. The second coating material 17 can be a plastisol, and in practice, the second coating material 17 does not contain a blowing agent.

From the second coating station 16 the strand 10 then advances to a second oven 18. Oven 18 can be a conventional thermal oven. In the second oven 18 the first and second coating materials are heated to fuse the two layers together and to activate the blowing agent contained therein. The processes, coating materials, sizings and apparatus of the system thus far described can be of any suitable type. For example, the processes, coating materials, sizings, and apparatus can be of the type described in U.S. Pat. No. 3,761,346, issued to Caroselli et al. on Sept. 25, 1973 which is incorporated by reference herein.

Upon leaving second oven 18 the resulting composite strand 20 is in a tacky and deformable state. That is, the temperature of the coating material thereon is such that the physical characteristics of the coating are not yet permanently set. The slightest excess in contact of the coating at that point will cause defects to be generated at the surface of the strand and/or strip the coating from the filaments of the strand. The deformation temperature of the coating material is that temperature below which the coated strand can contact guide rollers, other strands and the like without the coating being permanently deformed.

The first cooling station or zone 25 is located immediately adjacent the exit section of second oven 18. At the first station 25, a suitable gas, such as air, is directed upwardly at composite strand 20 at a volume, velocity, and temperature sufficient to cool and support the composite strand 20. That is, as composite strand 20 advances through the first cooling zone, strand 20 substantially gently floats across the top of foraminous plate 29 through which a plurality of streams of air are upwardly directed toward the strand 20.

Foraminous plate 29 is suitably attached to housing 27 having a blower or fan 31 located therein to direct streams of air through plate 29 to cool and support coated strand 20.

Upon leaving the first cooling zone 25 at least a skin has formed on the outer surface of the composite strand 20. That is, at least the outer surface of the coating on the strand is at a temperature below the deformation temperature of the coating material. It would be possible, but impractical, to entirely cool the coated strand using the above described air table technique. To decrease the amount of physical space needed to cool the strand, it is desirable to use a liquid, such as water, to cool the strand.

However, it has been found that the application of a stream or a heavy spray of water directly onto the coated strand immediately after leaving the second oven 18 produces a strand having a wrinkled surface with indentations therein. Furthermore, if a stream or spray of water was directed onto the strand 20 at a point wherein the coating only had a very thin skin at the outer surface, wrinkles and indentations still may form. Therefore, it is important that the kinetic energy with which the individual particles of the liquid, such as water, contact the composite strand 20 be as low as practically possible to reduce the tendency of the cooling liquid to wrinkle and dent the surface of the strand.

To accomplish this, strand 20 after leaving the first cooling zone 25 advances through a second cooling zone 36 having an atomized mist 50 of liquid therein. It has been found that a mist substantially consisting of tiny droplets of water having a diameter within a range from about 20 microns to about 300 microns is suitable for the purposes of this invention. It is preferred however, that the liquid droplets have a diameter within a range from about 25 microns to about 110 microns. Furthermore, it is believed that to be effective, the mass of the mist 50 within the second cooling zone 36 should be within the range of about 1.4 to about 1.8 times the mass of water that would be present in the zone if the relative humidity of the zone were 100%.

As shown in FIG. 1, the second cooling zone or mist cooler 36 is comprised of a housing 38 and a plurality of spray-heads 40 oriented above composite strand 20 to direct a body of atomized mist 50 from each spray-head 40 toward composite strand 20. Spray-heads 40 can be of any suitable type, and hydraulic atomizing nozzles, type LN 1.5, of the Spraying Systems Corporation, Randolph Street, Bellwood, Illinois have been found suitable for the purposes of this invention. A fog of water surrounds the strand as it advances through mist cooler 36. In operation, a majority of the water collects in reservoir 48 of housing 38 to be forced through piping 44 to manifold 42 and finally through spray-heads 40 by means of pump 46.

Upon leaving the second cooling zone 36 the composite strand 20 then advances through an air knife 55. Basically, an air knife is a pair of nozzles oriented to direct a pair of opposing streams of air towards the strand running therebetween. As shown, the nozzles are angled slightly in the direction of advancement of the strand passing therebetween. A suitable air knife 55 can be obtained from the Berlyn Corporation, Milbury, Massachusetts.

Basically, the strand is located in a horizontal plane by wiping dye in the second coating station and guide roller 57. That is, upon leaving the second oven 18 the strand is essentially unsupported except for the upwardly directed stream of gas at the first cooling zone 12 between the second oven 18 and the guide roller 57.

Strand 20 can be wound upon a conventional winder 59 as a wound package 61.

Figure 2:
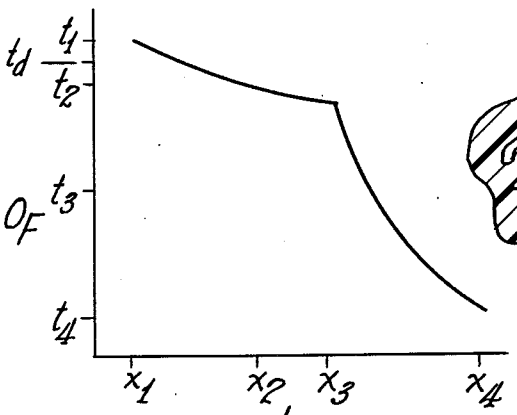
FIG. 2 is a graph depicting the surface temperature of the coated strand as it passes through the first and second cooling zones.

As shown in FIG. 2, given a uniform velocity for the advancing strand, the rate of cooling of the composite strand 20 from a point at x, to $x_2$ of the first cooling zone 25 is at a lower rate than the rate of cooling of the strand and the second cooling zone 36 from point $x_3$ to point $x_4$. Also, it can be seen that the surface temperature of the composite strand 20 is below the deformation temperature $T_d$ for the coating material as any particular point on the surface of the strand passes point $x_2$. Of course, the temperature of the coating material and its deformation temperature will vary according to the particular type of coating employed. In essence, however, the coating material is cooled at a first rate by directing a gas upwardly at the advancing strand to cool and support the strand and then cooling the strand at a second rate, greater than the first rate, by advancing the strand through a zone having an atomized mist of liquid therein.

Figure 3:
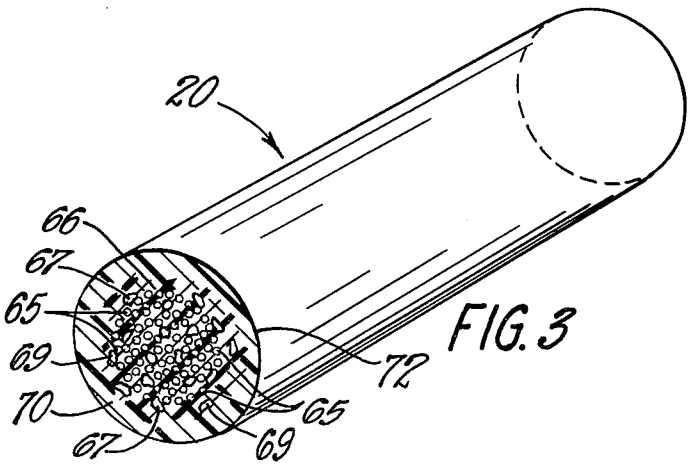
FIG. 3 is an enlarged view of the final product processed according to the principles of this invention.

If the first coating material is a plastisol containing a blowing agent and the second coating material is a plastisol that does not contain a blowing agent and is processed according to the principles of this invention, the resulting deposit strand has a substantially smooth, non-lustrous, unwrinkled outer surface over a foam core surrounding a centrally located bundle of filaments as shown in FIG. 3.

Figure 4:
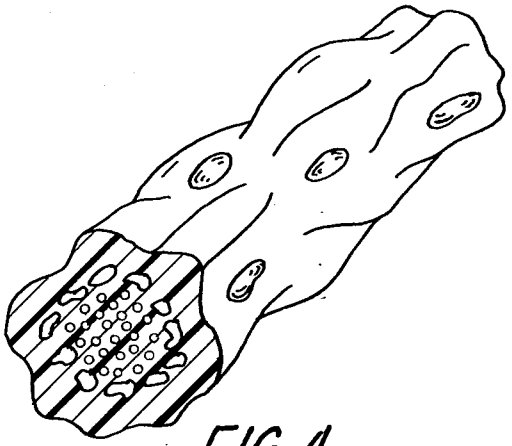
FIG. 4 (PRIOR ART)
FIG. 4 is an enlarged view of a similar product except that a stream of water has been directed against the strand to cool the strand (prior art).

As can be seen from FIGS. 3 and 4, the system using the cooling mode according to the principles of this invention and the system employing a water spray directly after leaving the second oven, respectively, there are substantial differences in the physical characteristics of the resulting end products even though the materials employed in producing the composite strand are essentially identical. Composite strand 20, as shown in FIG. 3, is comprised of a central core of filaments 65 surrounded by a first layer of material 66 containing voids 67 which is surrounded by an unfoamed layer 70 having an outer surface 72 thereon. A continuous composite strand having a substantially smooth, non-lustrous, unwrinkled outer surface can be produced according to the principles of this invention.

However, as shown in FIG. 4, the prior art composite strand, which is produced by applying water spray of large droplets or a coherent stream of water to the coated strand immediately after leaving the second oven, is comprised of a central bundle of filaments which is surrounded by a first layer of coated material having voids therein which is surrounded by a second layer of coating material having an outer surface characterized by a substantially wrinkled appearance having indentations randomly located along the surface.

It is apparent that within the scope of the invention, modifications and different arrangements can be made other than is herein disclosed. The present disclosure is merely illustrative with the invention comprehending all the variations thereof.

I claim:

1. A method of processing a coated bundle of filaments wherein said coating thereon is foamable comprising:

heating the coated bundle such that the coating is in a foamed and tacky state:

directing a gas at the coated bundle to cool the coating to at least form a skin on the outer surface of the coating; and then moving the coated bundle through a zone having an atomized mist of liquid therein to further cool the coating.

2. The method of claim 1 wherein the mist consists of liquid droplets having a diameter within the range from about 20 microns to about 300 microns.

3. The method of claim 2 wherein the mist consists of liquid droplets having a diameter within the range from about 25 microns to about 110 microns.

4. The method of claim 1 wherein the liquid is water and wherein the mass of the water within the zone as mist is within the range of about 1.4 to about 1.8 times the mass of water that would be present if the relative humidity of the zone were 100%.

5. The method of claim 1 wherein the gas has a volume and velocity sufficient to support and cool the coated bundle.

6. The method of processing a coated bundle of filaments wherein said coating thereon is foamable comprising:

heating the coated bundle sufficiently to foam the coating;

then cooling the coated bundle at a first rate to form a skin on the coating; and then moving the coated bundle through a zone having an atomized mist of liquid therein to cool the strand at a second rate greater than the first rate in the absence of substantially deforming said skin.

7. The method of claim 6 wherein the coating is cooled at the first rate until the temperature of at least the skin of the coating is less than the deformation temperature of the coating.

8. The method of claim 7 wherein the coating is cooled at the first rate by directing a gas at the coated bundle to cool the coating.

9. The method of claim 8 wherein the mist consists of liquid droplets having a diameter within the range from about 20 microns to about 300 microns.

10. The method of claim 9 wherein the mist consists of liquid droplets having a diameter within the range from about 25 microns to about 110 microns.

11. The method of claim 10 wherein the liquid is water and wherein the mass of the water existing as mist within the zone is within the range of about 1.4 to about 1.8 times the mass of water that would be present if the relative humidity of the zone were 100%.

12. The method of claim 11 wherein the coating consists of a first layer of a first material having a blowing agent and an outer layer of a second material not having a blowing agent such that said coated bundle has a smooth, non-lustrous, unwrinkled outer surface over a foam core.

13. The method of claim 12 wherein the first rate is slow enough to permit the coating to substantially expand to the maximum extent thereof.

14. A method of claim 13 wherein the gas directed at the coated bundle has a velocity and volume sufficient to cool and support the coated bundle.

* * * * *